US006203349B1

(12) United States Patent
Nakazawa

(10) Patent No.: US 6,203,349 B1
(45) Date of Patent: Mar. 20, 2001

(54) ELECTRICAL CONNECTOR WITH A LOCKING MECHANISM

(75) Inventor: Yasuo Nakazawa, Gunma-ken (JP)

(73) Assignee: Hosiden Corporation, Osaka-fu (JP)

( * ) Notice: Subject to any disclaimer, the term of this patent is extended or adjusted under 35 U.S.C. 154(b) by 0 days.

(21) Appl. No.: 09/311,162

(22) Filed: May 13, 1999

(30) Foreign Application Priority Data

May 29, 1998 (JP) ..... 10-149430

(51) Int. Cl.[7] ..... H01R 13/62; H01R 13/213
(52) U.S. Cl. ..... 439/319; 439/314
(58) Field of Search ..... 439/314, 313, 439/319, 315, 488, 489

(56) References Cited

U.S. PATENT DOCUMENTS

| | | | | |
|---|---|---|---|---|
| 2,984,811 | * | 5/1961 | Hennessey, Jr. et al | 439/153 |
| 3,287,031 | * | 11/1966 | Simmons et al. | 285/27 |
| 4,531,798 | * | 7/1985 | Baur et al. | 439/368 |
| 5,641,310 | * | 6/1997 | Tiberio, Jr. | 439/680 |

* cited by examiner

*Primary Examiner*—Brian Sircus
*Assistant Examiner*—Brian S. Webb
(74) *Attorney, Agent, or Firm*—Jones, Tullar & Cooper, P.C.

(57) ABSTRACT

The present invention relates to an electrical connector with a locking mechanism which is to be locked to a counter electrical connector by insertedly connecting the connector to the counter electrical connector and then conducting a given rotating operation, and in which only a given rotation operation is required for enabling a locking state to be naturally canceled by a spring force. According to the present invention, irrespective of whether the electrical connector has a single pole or plural poles, the connectors can be connected and locked to each other without requiring an adjustment of a lock ring in the peripheral direction, only by determining the fitting position. In the electrical connector with a locking mechanism of the present invention, a lock ring at the initial position is positioned by fitting between a protruding portion disposed on a fitting portion, and a recess portion disposed in a lock ring fitted onto the fitting portion. When the lock ring is positioned by the fitting of the protruding portion and the recess portion, a fitting mechanism conducts the positioning operation and a connector is insertedly connected to the counter connector. Then, an outward projection of the counter electrical connector is fitted into a slot of the lock ring. The lock ring is always urged in the advancing direction by a spring member.

12 Claims, 11 Drawing Sheets

ELECTRICAL CONNECTOR WITH A LOCKING MECHANISM

BACKGROUND OF THE INVENTION

1. Field of the Invention

The present invention relates to an electrical connector with a locking mechanism, and more particularly to an electrical connector with a locking mechanism by which a coupling state with a counter electrical connector is locked by conducting a given rotation operation after the electrical connector is insertedly connected to the counter electrical connector. The present invention relates also to an electrical connector with a locking mechanism in which only a given rotation operation is required for enabling a locking state to be naturally canceled by a spring force.

2. Description of the Prior Art

FIG. 10 diagrammatically shows a prior art electrical connector with a locking mechanism. In the connector C3 of the figure, a cylindrical lock ring 110 is attached to the connector body 100 so as to be longitudinally movable. The connector C3 is insertedly connected to a counter electrical connector C4, and a female thread 111 of the lock ring 110 is then screwed with a male thread 112 formed on the counter electrical connector C4. As a result, the connectors C3 and C4 are locked to each other so as not to drop off.

FIG. 11 diagrammatically shows another prior art electrical connector with a locking mechanism. When the connector C5 of the figure is insertedly connected to a counter electrical connector C6, an engaging piece 210 formed on the connector body 200 is automatically engaged with an engaging portion 220 of the counter electrical connector C6, and the connectors C5 and C6 are locked to each other so as not to drop off. When a pressing portion 230 formed on the connector body 200 is pressed by a finger in the locking state so as to bend inwardly the engaging piece 210, the locking state is canceled and the connector C5 can be extracted from the counter electrical connector C6.

FIG. 12 diagrammatically shows a further prior art electrical connector with a locking mechanism. The connector C7 of the figure has one pole 325. A cylindrical lock ring 310 is attached to the connector body 300 of the connector C7 so as to be rotatable and axially movable. The lock ring 310 is always urged toward the illustrated initial position in the retracting direction, by a spring member (not shown) which is interposed between the connector body 300 and the lock ring 310. A slot 320 which elongates in the spiral direction is opened in the lock ring 310. An engaging holding face 322 is sectionally formed in the hole wall face 321 of the slot 320. When the connector C7 is insertedly connected to a counter electrical connector C8 and the lock ring 310 is then rotated, the entire wall face 321 of the slot 320 is engaged with an outward projection 324 disposed on the counter electrical connector C8, so that the lock ring 310 is moved forward, whereby the outward projection 324 is engaged with the engaging holding face 322, with the result that the connectors C7 and C8 are locked to each other so as not to drop off. When the lock ring 310 in the locking state is reversely rotated, the locking state is naturally canceled by the spring force and the connector C7 can be extracted from the counter electrical connector C8.

Among the above-described prior art connectors C3, C5, and C7 of FIGS. 10, 11, and 12, the connector C7 of FIG. 12 has excellent locking operability because a locking operation can be completed only by insertedly connecting the connector to the counter electrical connector C8 and then slightly rotating the lock ring 310. Furthermore, the connector C7 has an advantage that, when the outward projection 324 of the counter electrical connector C8 and the slot 320 of the lock ring 310 of the connector C7 are formed in two places which are separated from each other by 180°, high locking stability is obtained wherein an offset load hardly occurs.

In the connector C7 of FIG. 12, in the case where the connector has a single pole 325 as illustrated, even when the lock ring 310 at its initial position is rotatable with respect to the connector body 300, the locking operation can be conducted by insertedly connecting the connectors C7 and C8 to each other at a position where the outward projection 324 of the counter electrical connector C8 can be fitted into the slot 320 of the lock ring 310, and then rotating the lock ring 310. In the case where the connector C7 is a multipolar connector having plural poles, when the connectors C7 and C8 are to be insertedly connected to each other, it is required to conduct a two-step positioning operation in which the fitting positions in the peripheral direction of the connectors are first determined in order to enable the poles (not shown) of the connectors to be adequately connected to each other, and the lock ring 310 is then rotated so as to adjust the position of the slot 320 in the peripheral direction to the position where the outward projection 324 of the counter electrical connector CB can be fitted into the slot. This prevents the connection work from being conducted rapidly and smoothly.

SUMMARY OF THE INVENTION

The present invention has been developed in view of the above-mentioned circumstances.

It is an object of the invention to provide an electrical connector with a locking mechanism in which the basic structure of the connector C7 of FIG. 12 that has a single pole is employed as it is, and the lock ring at the initial position can be positioned in the rotation direction.

It is another object of the present invention to provide an electrical connector with a locking mechanism in which, even in the case of a multipolar electrical connector with a locking mechanism, when the electrical connector with a locking mechanism is to be connected to a counter electrical connector, the connectors can be surely connected and locked to each other without requiring an adjustment of a lock ring in the rotation direction, only by determining a fitting position where poles of the connectors can be adequately connected to each other.

In the electrical connector with a locking mechanism according to the present invention, the presumption portion has a configuration comprising:

- a cylindrical fitting portion which can be fitted into a cylindrical fitted portion of a counter electrical connector;
- a cylindrical lock ring which is attached to the fitting portion so as to be rotatable and axially movable;
- a guide face which is formed on the lock ring, which elongates in a spiral direction, and to which, when the fitting portion is fitted into the fitted portion, an outward projection disposed on the fitted portion is opposed;
- a cam face and an engaging face which is continuous with the cam face, the cam face and the engaging face being sectionally formed in the guide face, and, when the lock ring is rotated, being engaged with the outward projection to guide the lock ring toward a lock position in an advancing direction; and
- a spring member which always urges the lock ring toward an initial position in a retracting direction.

The configuration of the presumption portion is formed also in the prior art connector C7 which has been described with reference to FIG. 12. According to the electrical connector with a locking mechanism of the present invention having this configuration, a locking operation can be completed only by insertedly connecting the connector to the counter electrical connector and then slightly rotating the lock ring, and hence the connector has excellent locking operability. Furthermore, the connector has an advantage that, when the outward projection of the counter electrical connector and the slot of the lock ring are formed in two places which are separated from each other by 180°, high locking stability wherein an offset load hardly occurs is obtained. When the lock ring in the locking state is reversely rotated, the locking state is naturally canceled by the spring force and the connector can be extracted from the counter electrical connector.

The electrical connector with a locking mechanism according to the present invention has, in addition to the presumption portion, a positioning mechanism as the configuration of the characterizing portion. The positioning mechanism is formed by a protruding portion and a recess portion which is to be fitted onto and unfitted from the protruding portion, the protruding portion and the recess portion being respectively formed on the fitting portion and the lock ring. Furthermore, the positioning mechanism is configured so that it restricts the rotation angle of the lock ring at the initial position and the restriction state of the rotation angle of the lock ring which is caused by the protruding portion and the recess portion is canceled by a forward movement of the lock ring toward the lock position.

According to the present invention, the position in the rotation direction of the lock ring at the initial position is always determined by the positioning mechanism, and hence there arises no case where the lock ring is rotated to a position other than that which is determined by the positioning mechanism. Irrespective of whether the electrical connector with a locking mechanism has a single pole or plural poles, when the connector is to be connected to a counter electrical connector, therefore, the connectors can be surely connected and locked to each other without requiring an adjustment of the lock ring in the peripheral direction, only by determining the fitting position where the poles of the connectors can be adequately connected to each other.

In the electrical connector with a locking mechanism according to the present invention, preferably, a width of the recess portion of the positioning mechanism is larger than a width of the projection of the positioning mechanism, and an idle space is formed between the projection and the recess portion. According to this configuration, the dimensional accuracy of the resin molding of the lock ring and the fitting portion on which the protruding portion and the recess portion of the positioning mechanism are respectively formed can be relaxed.

In the electrical connector with a locking mechanism according to the present invention, preferably, an edge portion which protrudes toward an inner side of the lock ring is annularly formed on a rear end portion of the lock ring, the recess portion of the positioning mechanism is formed in one place in a peripheral direction of the edge portion, a trunk portion is continuously disposed on a base of the fitting portion in a stepwise manner, the trunk portion having a diameter which is larger than a diameter of the fitting portion, the protruding portion of the positioning mechanism is formed in a step portion in an interface between the trunk portion and the base, and a step face of the step portion is formed as an abutting face which restricts the initial position of the lock ring.

According to this configuration, the places where the protruding portion and the recess portion of the positioning mechanism are to be respectively formed can be specifically determined. Since the protruding portion is formed on the side of the fitting portion, it is not required to form the recess portion on the side of the fitting portion. This serves to easily ensure a required mechanical strength for the fitting portion which is to be fitted onto and unfitted from the cylindrical fitted portion of the counter electrical connector.

In the electrical connector with a locking mechanism according to the present invention, preferably, a spring seat is formed in place of the fitting portion, the place being positioned more forward than the protruding portion, and the spring member is interposed between the spring seat and the edge portion of the lock ring. According to this configuration, the spring member is covered by the lock ring so as not to be exposed to the outside.

In the electrical connector with a locking mechanism according to the present invention, preferably, a projection and a groove portion which is to be fitted onto and unfitted from the projection are respectively formed on the fitting portion and the fitted portion, the projection and the groove portion form a fitting mechanism which restricts a fitting position between the fitting portion and the fitted portion in a peripheral direction, and an introducing groove for introducing the outward projection to the cam face is formed in the lock ring, the introducing groove elongating from a front end face of the lock ring to a beginning portion of the cam face.

According to this configuration, the fitting position between the fitting portion and the fitted portion in the peripheral direction can be determined by positioning the projection and the groove portion of the fitting mechanism. Even when the connector is a multipolar connector having plural poles, therefore, the poles of the connector can be adequately connected to those of a counter electrical connector. In spite of the above, the position of the lock ring in the peripheral direction is determined to a given position by the positioning mechanism, and hence the connectors can be surely connected and locked to each other without requiring an adjustment of the lock ring in the peripheral direction, only by determining the fitting position where the poles of the connectors can be adequately connected to each other.

In the electrical connector with a locking mechanism according to the present invention, preferably, a width of an opening of the introducing groove in the front end face of the lock ring is larger than a thickness of the outward projection, and, when the projection of the fitting mechanism is positioned with respect to the groove portion, the outward projection is always opposed to the opening of the introducing groove in the front end face of the lock ring.

According to this configuration, even if an idle space is formed between the projection and the recess portion of the positioning mechanism, when the connector is to be connected to a counter electrical connector, the connectors can be surely connected and locked to each other without requiring an adjustment of the lock ring in the rotation direction.

In the electrical connector with a locking mechanism according to the present invention, preferably, plural poles are arranged inside the fitting portion. Such a connector is used as a multipolar connector, and the plural poles are protected by the cylindrical fitting portion.

In the electrical connector with a locking mechanism according to the present invention, the guide face may be formed by an entire wall face of a slot which is formed in the lock ring and which elongates in the spiral direction. Preferably, a mark indicating a position of the projection of the fitting mechanism is formed on an outer face of the trunk portion. Preferably, another mark indicating a rotation direction for forward moving the lock ring is formed on an outer face of the lock ring.

As described above, according to the present invention, even when a connector having plural poles is to be connected to a counter electrical connector, the connectors can be surely connected and locked to each other without requiring an adjustment of a lock ring in the rotation direction, only by determining a fitting position where poles of the connectors can be adequately connected to each other. Therefore, it is possible to provide a connector having excellent connecting operability and locking operability.

The configuration and function of the present invention will be more apparent from the following description of embodiments.

DETAILED DESCRIPTION OF THE PREFERRED EMBODIMENT

A preferred embodiment of the electrical connector with a locking mechanism according to the present invention will be described.

Figure 1:
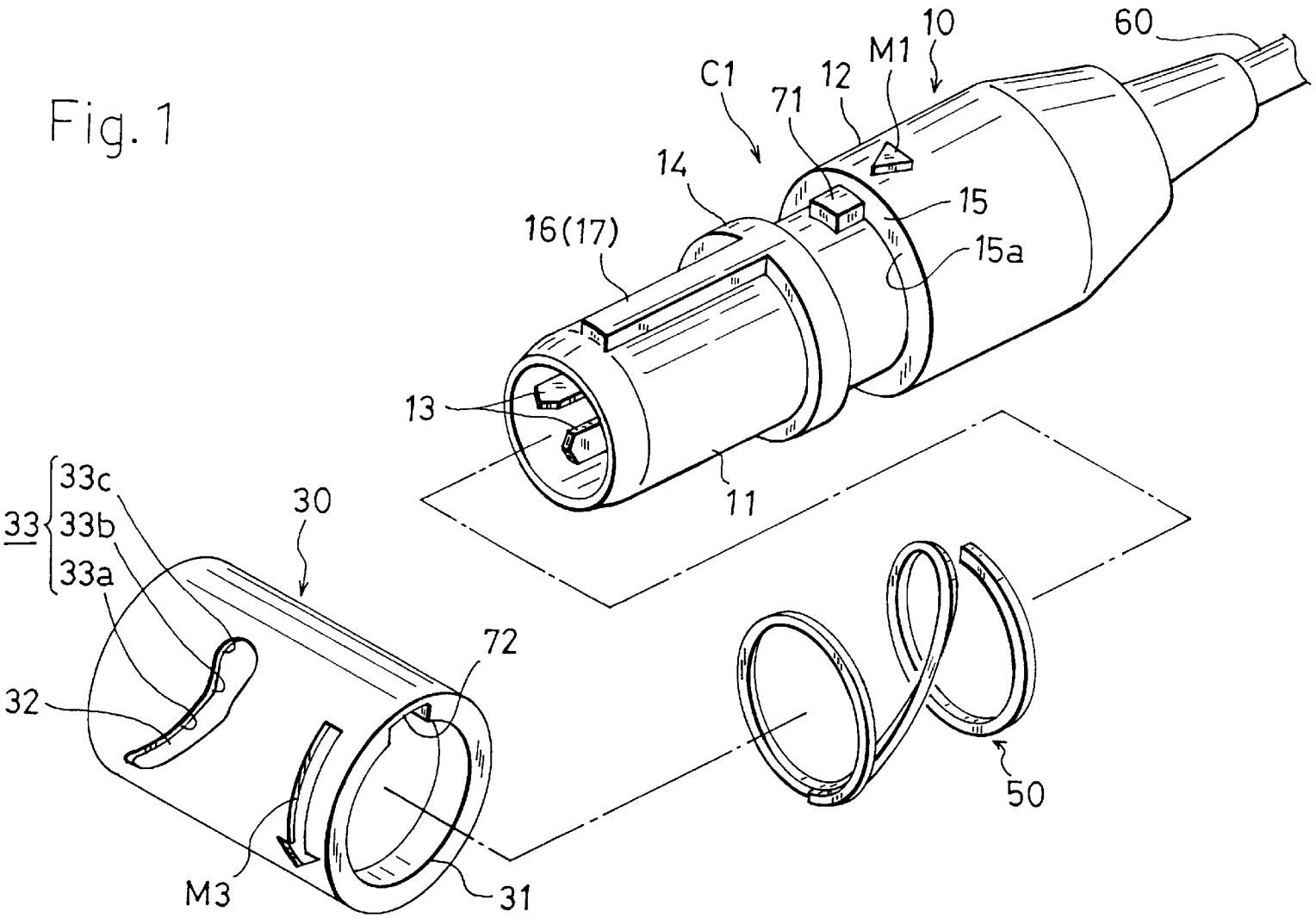
FIG. 1 is an exploded perspective view diagrammatically showing an electrical connector with a locking mechanism of an embodiment of the present invention.

As shown in FIG. 1, the electrical connector with a locking mechanism (hereinafter, referred to merely as "connector") C1 comprises the connector body 10, a lock ring 30, and a spring member 50.

The connector body 10 is formed from a synthetic resin molded member. In the connector body 10, a trunk portion 12 is continuously disposed on a base of a cylindrical fitting portion 11. The trunk portion 12 is larger in diameter than the fitting portion 11. Plural poles 13 are disposed inside the fitting portion 11 in a predetermined arrangement. The poles 13 are fixed to the connector body 10. Plural conductors (not shown) of an electric cord 60 which is passed through the trunk portion 12 are connected to the poles 13, respectively. The poles 13 may be pin poles, or strip-like poles, or have another shape. A spring seat 14 is annularly formed on the outer periphery of the fitting portion 11. A projection 16 which extends axially from the spring seat 14 is formed on the outer periphery of the fitting portion 11 and in front of the spring seat 14.

Figure 5:
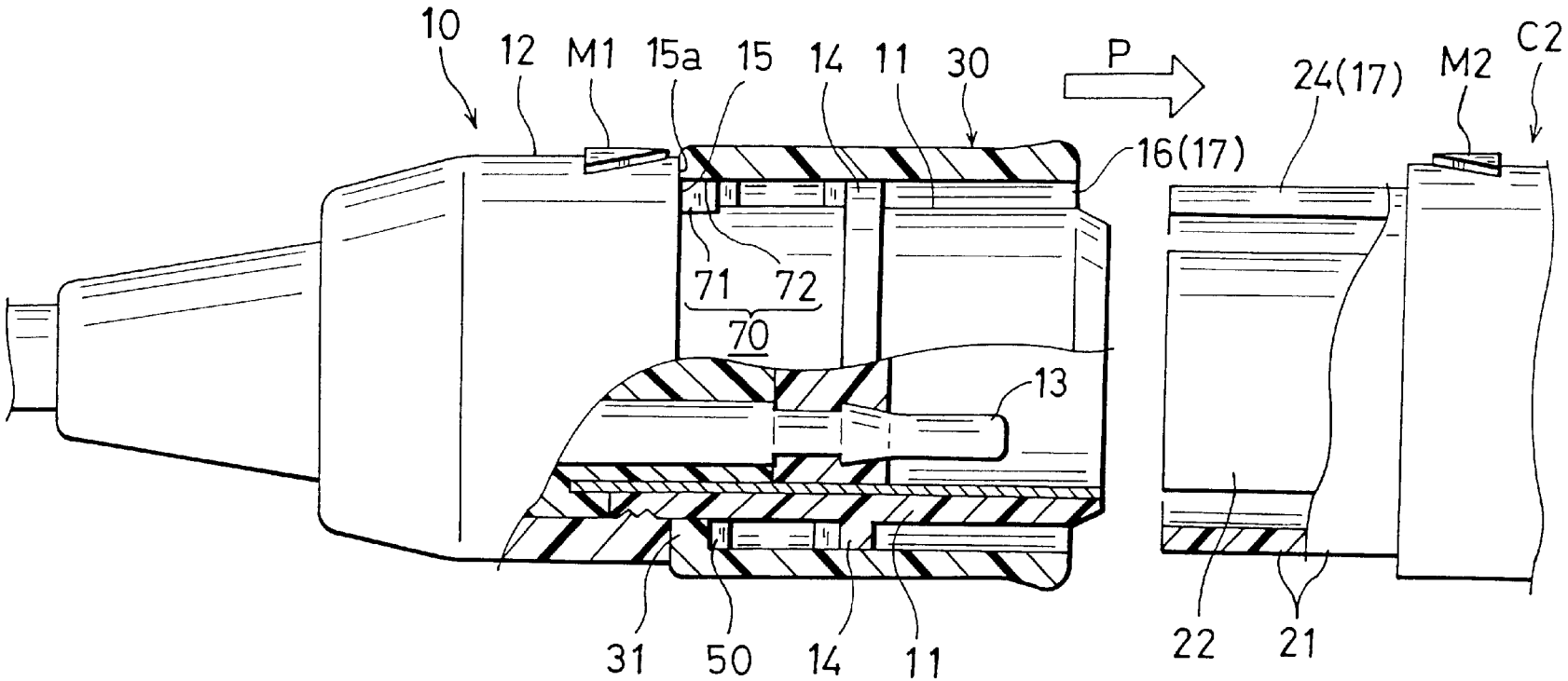
FIG. 5 is a partially cutaway diagrammatic side view illustrating a connecting operation.

The lock ring 30 is formed from a synthetic resin molded member. An annular edge portion 31 is formed in a rear edge portion of the lock ring 30 so as to protrude into the lock ring. As shown in FIG. 5, the lock ring 30 is fitted onto a fitting portion 11 of the connector body 10. In a state where the lock ring 30 is fitted onto the connector body 10, the edge portion 31 is placed between the large-diameter trunk portion 12 and the spring seat 14 of the connector body 10. A spring member 50 which is fitted into the fitting portion 11 is interposed and held between the edge portion 31 and the spring seat 14.

In a step portion 15 in an interface between the trunk portion 12 and the base of the fitting portion 11, a protruding portion 71 is disposed in one place of the peripheral direction of the step portion. By contrast, a recess portion 72 which can be fitted onto and unfitted from the protruding portion 71 is disposed in one place of the peripheral direction of the edge portion 31 of the lock ring 30. The protruding portion 71 and the recess portion 72 constitute a positioning mechanism 70 for restricting the relative position of the lock ring 30 in the peripheral direction with respect to the fitting portion 11. As shown in FIG. 6B, the width H1 of the recess portion 72 of the positioning mechanism 70 is larger than the width H2 of the protruding portion 71. When the lock ring 30 is retracted and the recess portion 72 is fitted onto the protruding portion 71, a gap is formed between the protruding portion 71 and the recess portion 72. The gap serves as an idle space S so that an idling rotation of the lock ring 30 is allowed within a predetermined angle range. FIG. 6B shows a state where the protruding portion 71 is fitted into the center place in the lateral direction of the recess portion 72. In this state, the lock ring 30 can be idly rotated in either of the rightward and leftward directions by an angle corresponding to the angle θ shown in the figure.

When the protruding portion 71 and the recess portion 72 of the positioning mechanism 70 are fitted to each other, the lock ring 30 abuts against the step face of the step portion 15 as shown in FIG. 5, thereby restricting the retracting position of the lock ring. The position in this state is the initial position of the lock ring 30. The step face of the step portion 15 is formed as an abutting face 15*a* which restricts the initial position of the lock ring 30. The lock ring 30 is always urged toward the initial position in the retracting direction by the force of the spring member 50.

A slot 32 which extends in the spiral direction is formed in two places of the peripheral wall of the lock ring 30 which are separated from each other by 180°. A front hole wall face of each of the slots 32 is formed as a guide face 33. The guide face 33 elongates in the spiral direction, and, as shown in FIGS. 1, 6A, 7A, 8A, and 9A, is sectioned into a cam face 33*a* which is inclined in the spiral direction, a chevron-shaped face 33*b* which is continuous from the end portion of the cam face 33*a*, and a recessed engaging face 33*c* which is continuous from the cam face 33*a* via the chevron-shaped face 33*b*.

Figure 4:
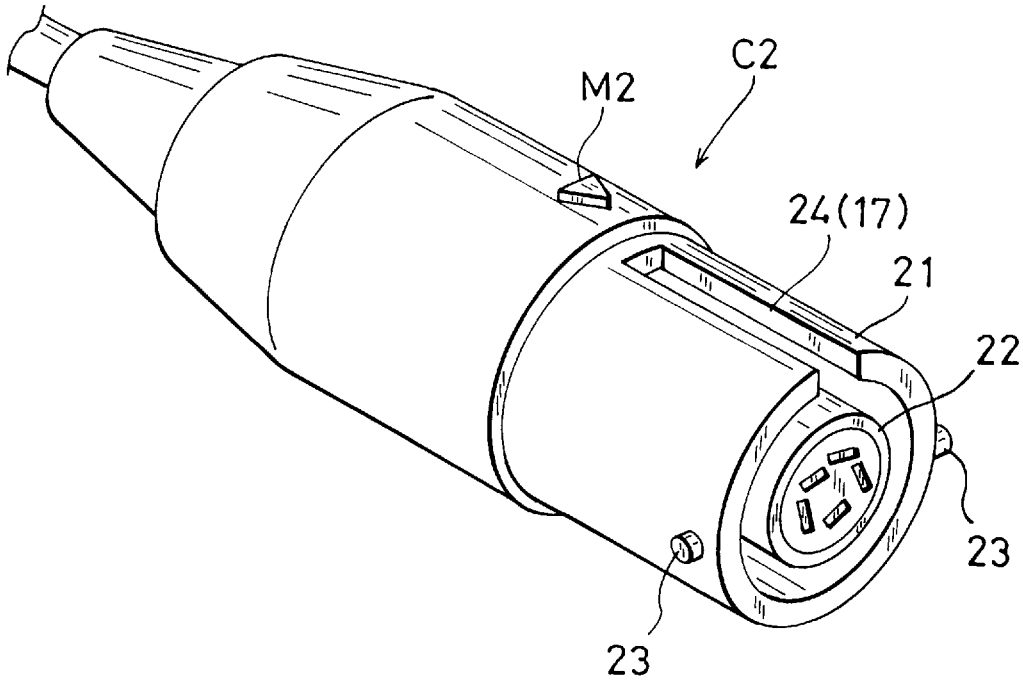
FIG. 4 is a diagrammatic perspective view of a counter electrical connector.

As shown in FIG. 4, a counter electrical connector (hereinafter, referred to merely as "counter connector") C2 has a cylindrical fitted portion 21, and the body 22 which is inside the fitted portion 21. Plural poles are disposed in the body 22. In the fitted portion 21, an outward projection 23 is formed in two places of the fitted portion which are separated from each other by 180° in the peripheral direction. A groove portion 24 which extends in the axial direction is formed in a center portion between the outward projections 23. The projection 16 shown in FIG. 1, and the groove portion 24 of the counter connector C2 constitute a fitting mechanism 17. The fitting mechanism 17 has the role of restricting the fitting position in the peripheral direction of the fitting portion 11 of the connector C1 and the fitted portion 21 of the counter connector C2. When the projection 16 of the fitting mechanism 17 is positioned with respect to the groove portion 24 and the fitting portion 11 is fitted into the fitted portion 21, the plural poles 13 of the connector C1 are adequately connected to the plural poles in the body 22 of the counter connector C2, respectively, thereby electrically connecting the connectors C1 and C2 to each other.

As shown in FIGS. 6A, 7A, 8A, and 9A, an introducing groove 34 which extends from the front end face of the lock ring 30 to the beginning portion of the cam face 33*a* is formed in the front end portion on the inner periphery side of the lock ring 30. The introducing groove 34 has a role of, when the projection 16 of the fitting mechanism 17 is positioned with respect to the groove portion 24 and the fitting portion 11 is fitted into the fitted portion 21, introducing the outward projection 23 of the counter connector C2 into the beginning portion of the cam face 33*a*. In the illustrated example, the width of the inlet part of the introducing groove 34, i.e., the groove width W (FIG. 6A) in the front end face of the lock ring 30 is larger than the thickness of the outward projection 23. Even in a state where the lock ring 30 at the initial position is idly rotated in the rightward direction or the leftward direction, therefore, the outward projection 23 of the counter connector C2 is surely introduced via the introducing groove 34 into the beginning portion of the guide face 33 when the projection 16 of the fitting mechanism 17 is positioned with respect to the groove portion 24 and the fitting portion 11 is fitted into the fitted portion 21.

Figure 6A:
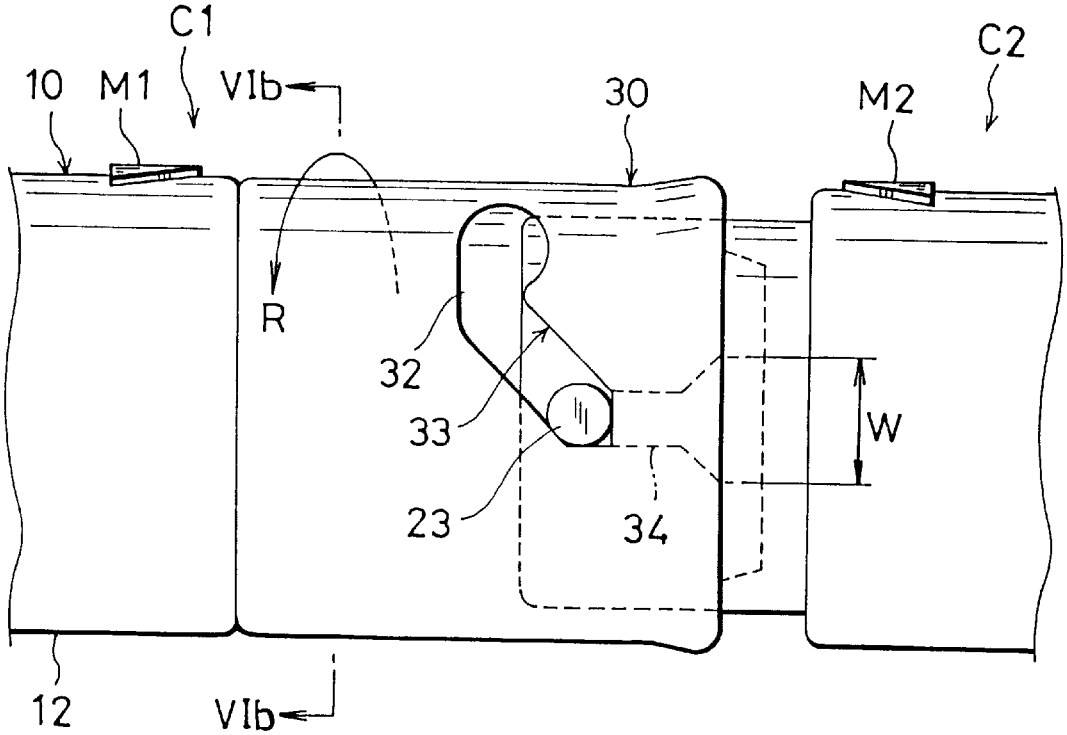
FIG. 6A is a diagrammatic side view of a state where the electrical connector with a locking mechanism of the present invention is connected to the counter electrical connector.
Figure 6B:
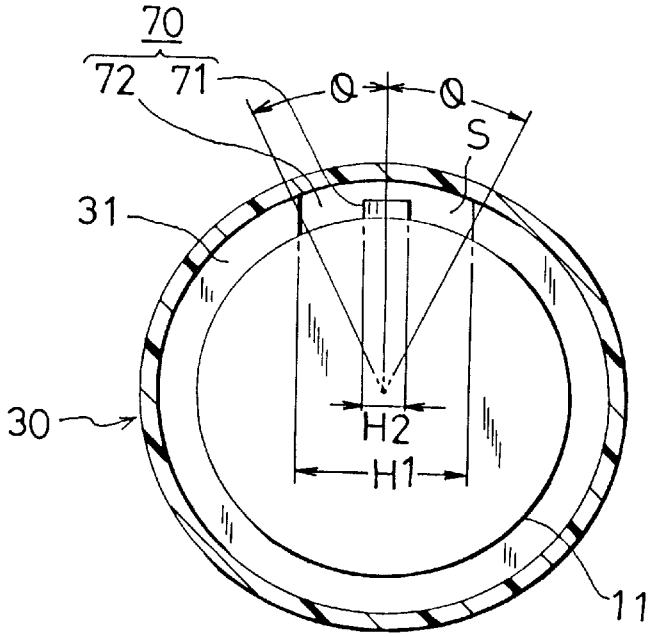
FIG. 6B is a diagrammatic section view taken along the line VIb—VIb of FIG. 6A.
Figure 7A:
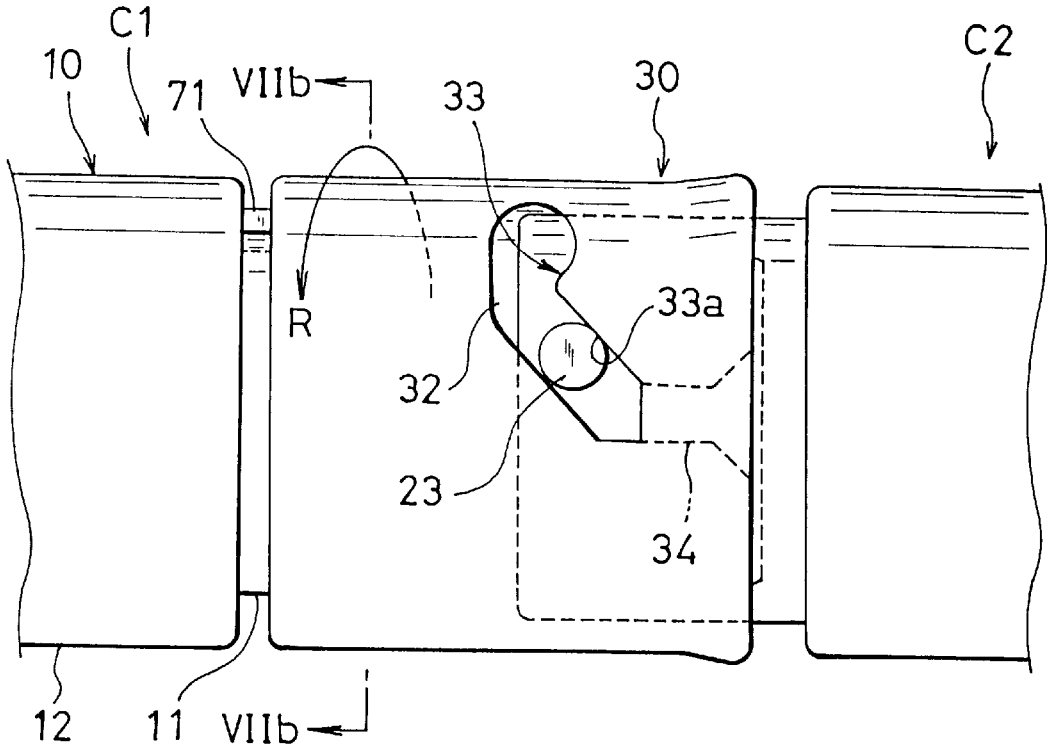
FIG. 7A is a diagrammatic side view showing an initial stage of a locking operation.
Figure 7B:
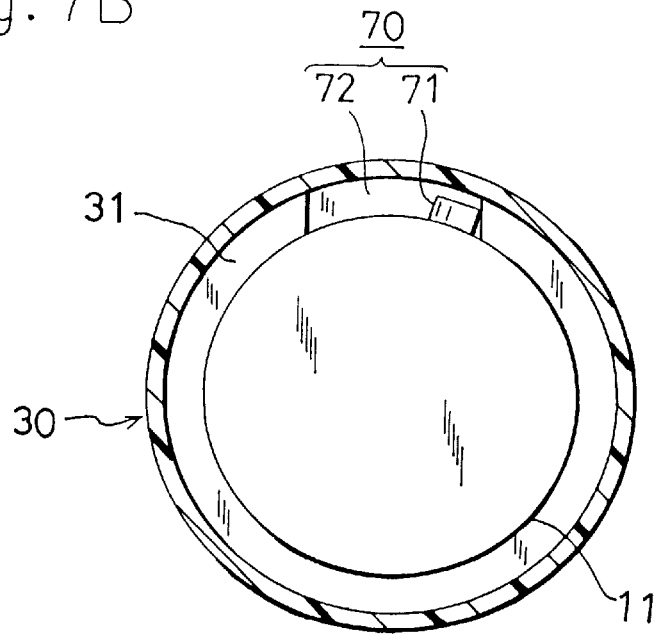
FIG. 7B is a diagrammatic sectional view taken along the line VIIb—VIIb of FIG. 7A.

In the connector C1 described above, when the projection 16 constituting the fitting mechanism 17 and on the side of the connector C1 is positioned with respect to the groove portion 24 on the side of the counter connector C2 and the fitting portion 11 is then fitted into the fitted portion 21 of the counter connector C2 as indicated by the arrow P of FIG. 5, the outward projection 23 of the counter connector C2 is fitted via the introducing groove 34 into the slot 32 formed in the lock ring 30 of the connector C1 as shown in FIGS. 6A and 6B, and then introduced into the beginning portion of the guide face 33. At this time, even if the lock ring 30 at the initial position is idly rotated in the rightward direction or the leftward direction, the above-mentioned action of the introducing groove 34 enables the outward projection 23 of the counter connector C2 to be surely introduced into the beginning portion of the cam face 33*a*.

After the fitting portion 11 of the connector C1 is fitted into the fitted portion 21 of the counter connector C2 to connect the connectors C1 and C2 to each other, the locking operation described below is conducted.

Figure 8A:
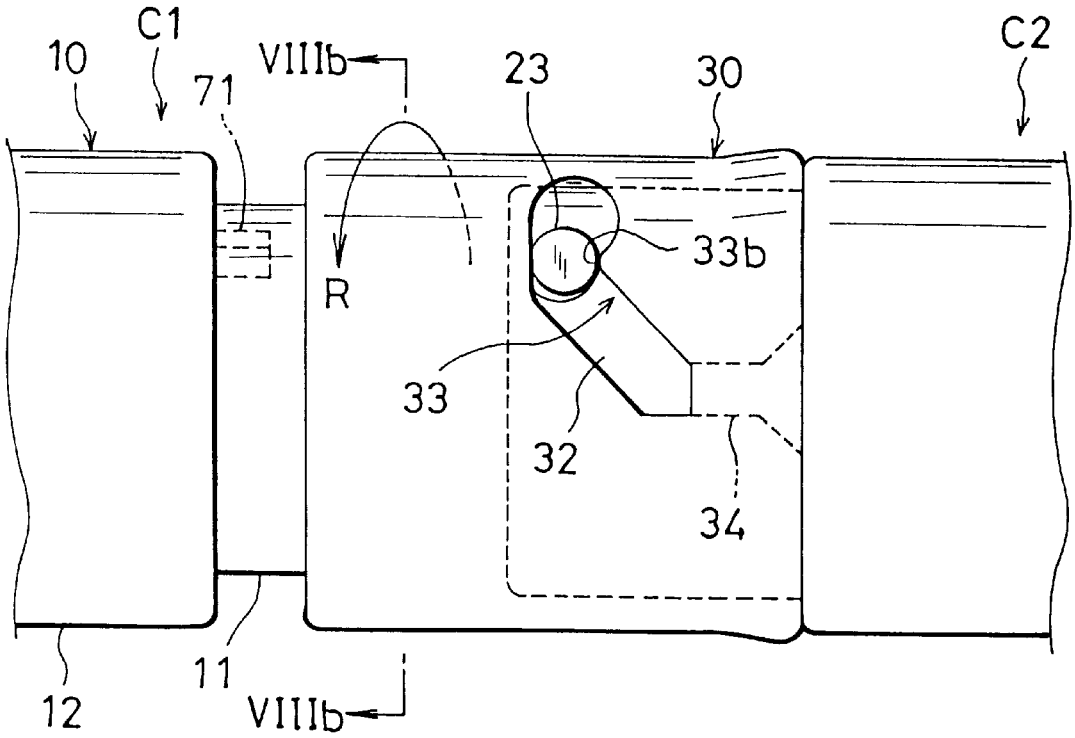
FIG. 8A is a diagrammatic side view showing an intermediate stage of the locking operation.
Figure 9A:
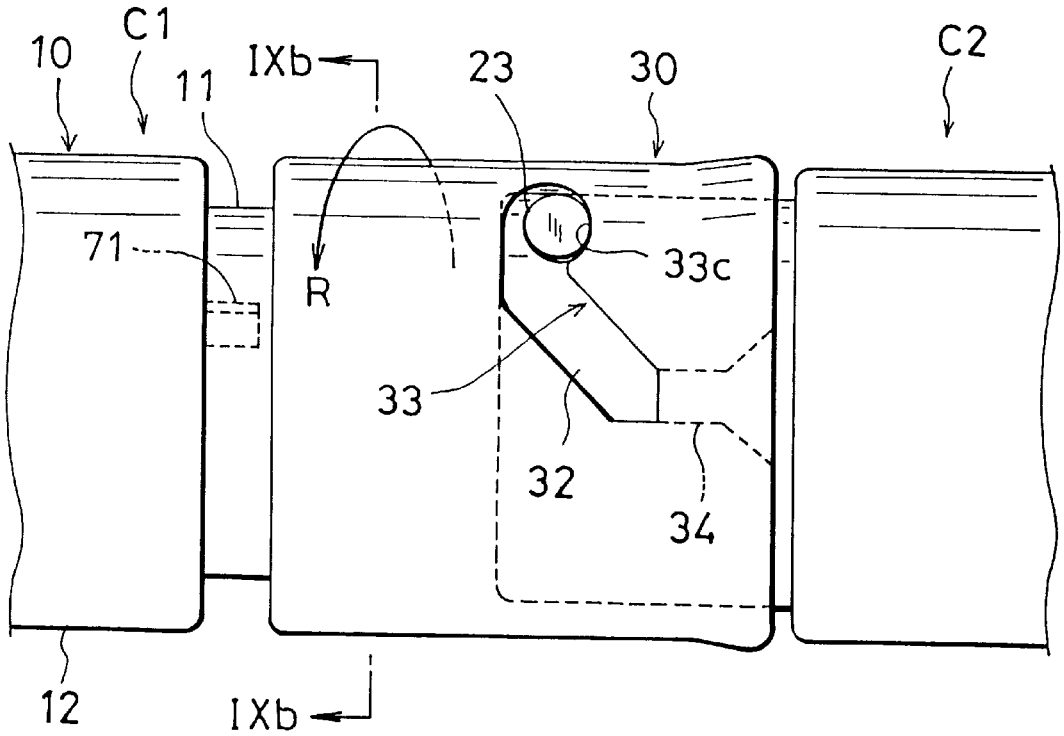
FIG. 9A is a diagrammatic side view showing a locking state.
Figure 9B:
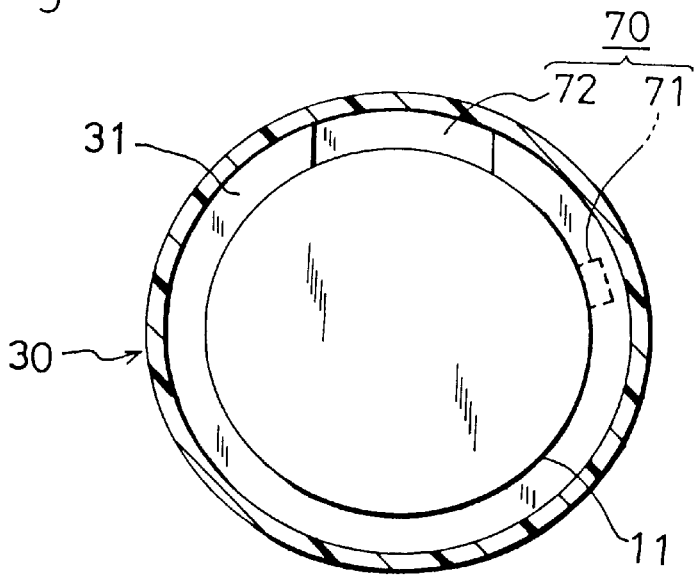
FIG. 9B is a diagrammatic section view taken along the line IXb—IXb of FIG. 9A.
Figure 10:
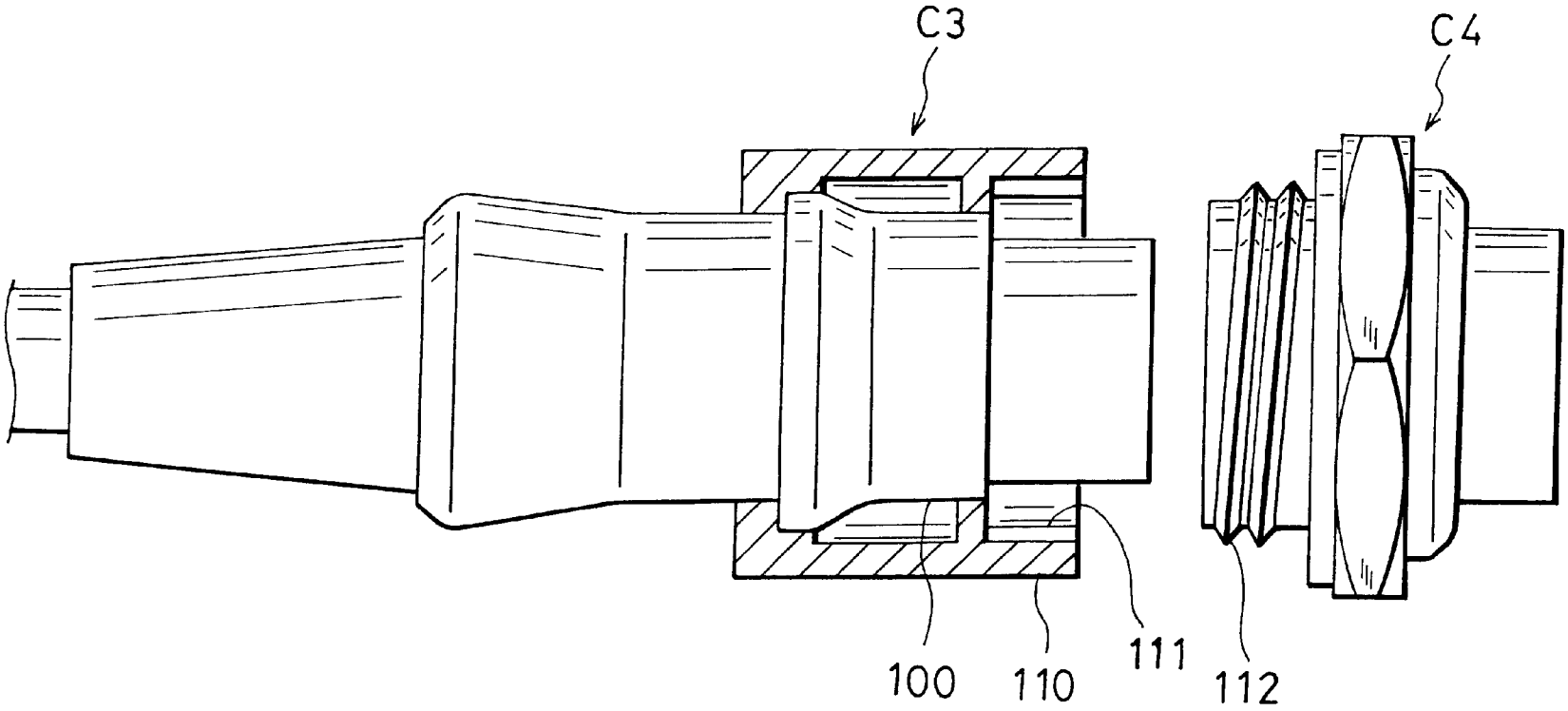
Fig. 10 (PRIOR ART)
FIG. 10 is a partially cutaway side view of a prior art example.
Figure 11:
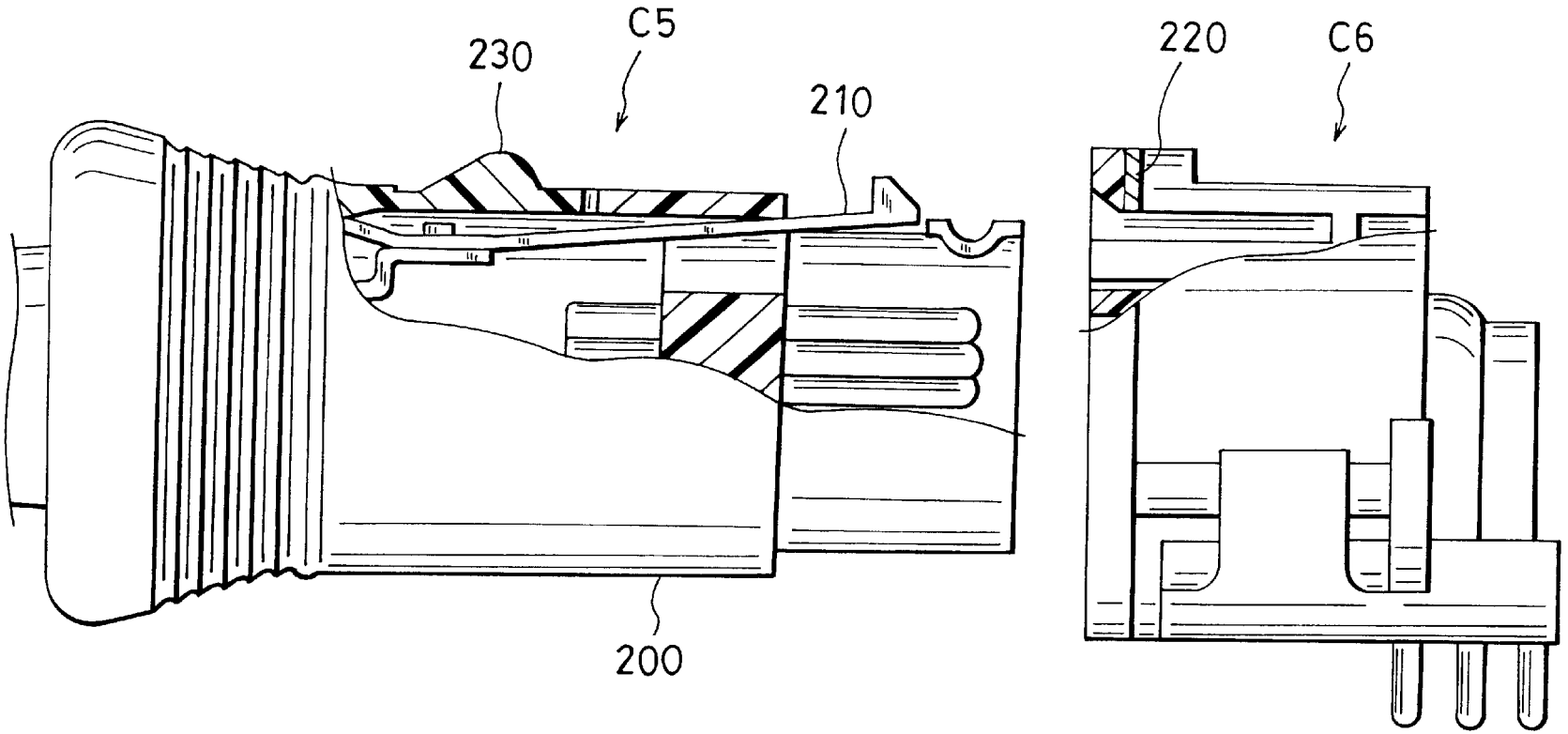
Fig. 11 (PRIOR ART)
FIG. 11 is a partially cutaway side view of another prior art example.
Figure 12:
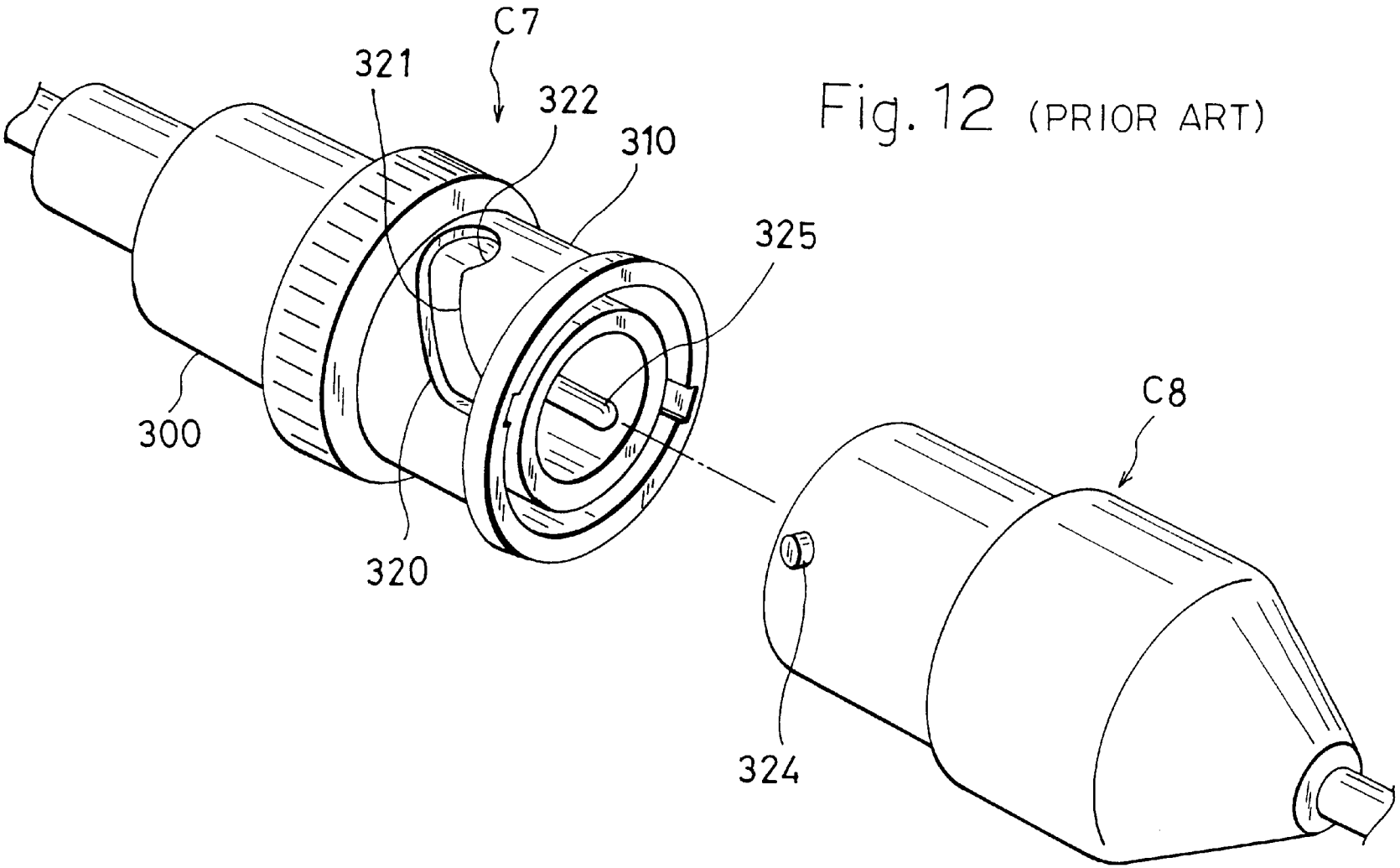
Fig. 12 (PRIOR ART)
FIG. 12 is a diagrammatic perspective view of a further prior art example.

In the locking operation, the lock ring 30 is rotated. Specifically, after the connectors C1 and C2 are connected to each other, the lock ring 30 is rotated in the direction R (the rightward direction as seen from the side of the connector C1) along which the cam face 33*a* abuts against the outward projection 23. Then, the cam face 33*a* is pushed forward by the outward projection 23, and hence the lock ring 30 is moved forward against the force of the spring member 50 while being rotated. Therefore, the engaging position between the cam face 33*a* and the outward projection 23 is moved via the position of FIG. 7A, and the chevron-shaped face 33*b* then overrides the outward projection 23 as shown in FIG. 8A. Thereafter, the chevron-shaped face 33*b* passes over the outward projection 23 and the engaging face 33*c* is engaged with the outward projection 23 as shown in FIG. 9A, thereby attaining a locking state.

Figure 8B:
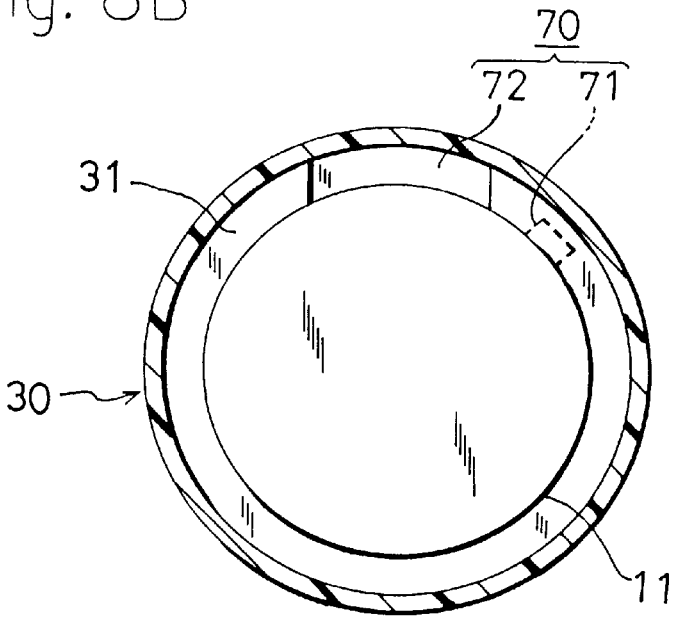
FIG. 8B is a diagrammatic section view taken along the line VIIIb—VIIIb of FIG. 8A.

In the case where the above-mentioned locking operation is to be conducted, when the lock ring 30 is located at the initial position, the recess portion 72 is fitted into the protruding portion 71 of the positioning mechanism 70. Therefore, it is impossible to rotate the lock ring 30 so as to exceed the above-mentioned range of the idling rotation while the lock ring 30 is maintained to be located at the initial position. By contrast, when the connectors C1 and C2 are connected to each other, the outward projection 23 of the counter connector C2 is introduced into the beginning portion of the guide face 33, and, when the lock ring 30 is rotated, the cam face 33*a* is engaged with the outward projection 23 to moved forward the lock ring 30. When the lock ring 30 is moved forward in this way, the recess portion 72 of the positioning mechanism 70 escapes from the protruding portion 71 of the mechanism as shown in FIGS. 8A and 8B and the restriction state (positioning state) of the rotation angle of the lock ring 30 is canceled. Therefore, the locking operation can be conducted only by connecting the connectors C1 and C2 to each other and then rotating the lock ring 30.

When the locking state is to be canceled, the lock ring 30 is reversely rotated. As a result, the chevron-shaped face 33*b* overrides the outward projection 23 engaged with the engaging face 33*c*, the cam face 33*a* is then engaged with the outward projection 23, and the beginning portion of the guide face 33 reaches the outward projection 23. This causes the locking state to be canceled. Thereafter, the connector C1 is extracted from the counter connector C2.

Figure 2:
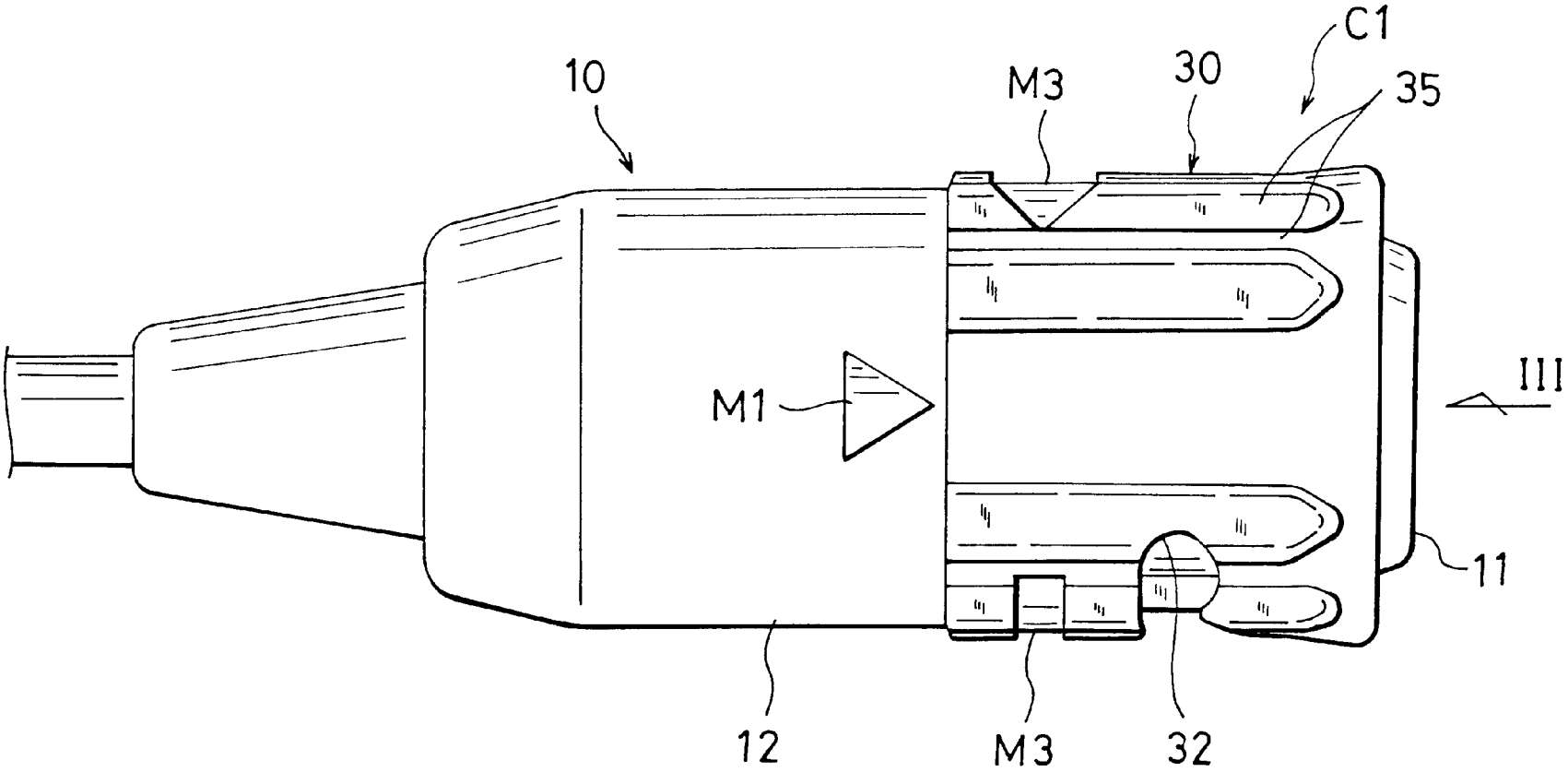
FIG. 2 is a diagrammatic side view of the connector.
Figure 3:
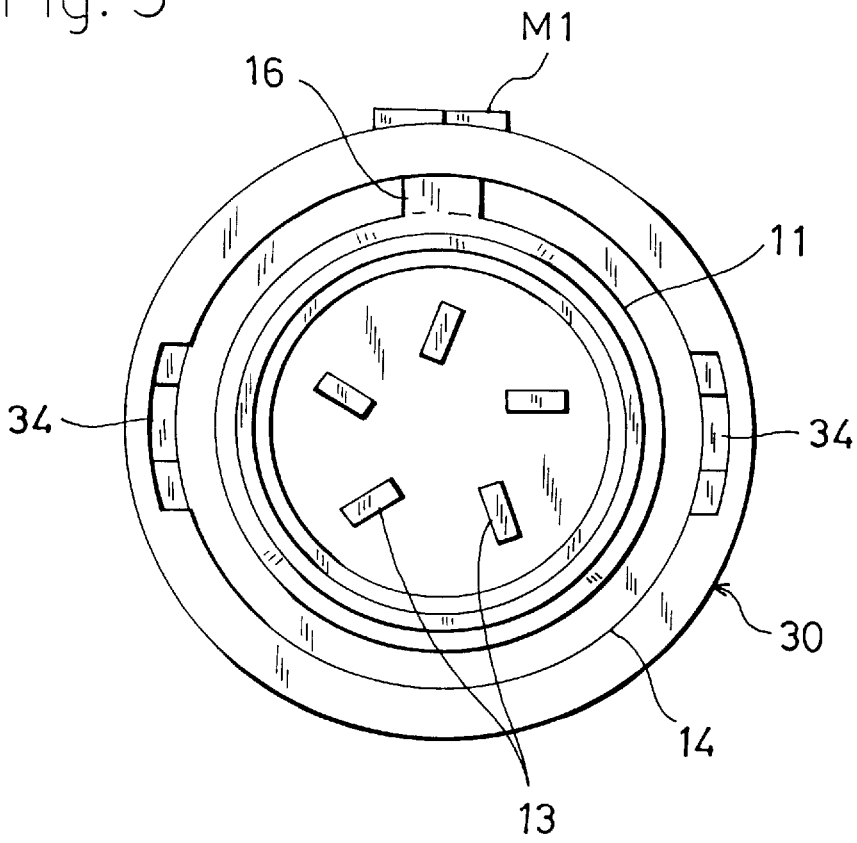
FIG. 3 is a view looking in the direction of the arrow III in FIG. 2.

In the illustrated embodiment, as shown in FIGS. 1 to 3, 5, and 6A, a triangular mark M1 indicating the position of the projection 16 of the fitting mechanism 17 is formed on the outer face of the trunk portion 12 of the connector C1. By contrast, as shown in FIGS. 4 to 6A, a triangular mark M2 indicating the position of the groove portion 24 of the fitting mechanism 17 is formed on the outer face of the counter connector C2. According to this configuration, positioning of the projection 16 of the fitting mechanism 17 with respect to the groove portion 24 can be simply realized by matching only the marks M1 on the side of the connector C1 to the mark M2 on the side of the counter connector C2. Therefore, the workability of connecting the connectors C1 and C2 to each other is improved. When a mark M3 indicating the rotation direction of the lock ring 30 in the locking operation is formed on the outer periphery of the lock ring 30 as shown in FIGS. 1 and 2, there is an advantage that, when the connectors C1 and C2 are connected to each other and then locked by moving forward the lock ring 30 while rotating the ring, the rotation direction of the lock ring 30 can be known from the mark M3 at a glance. As shown in FIG. 2, a rugged face 36 is formed on the outer periphery of the lock ring 30 in order to prevent fingers holding the lock ring 30 in the locking operation from slipping.

In the connector C1, the protruding portion 71 and the recess portion 72 of the positioning mechanism 70 are respectively formed on the fitting portion 11 and the lock ring 30, and it is not always required to form the protruding portion 71 on the fitting portion 11 and the recess portion 72 on the lock ring 30. When the protruding portion 71 is formed on the fitting portion 11 and the recess portion 72 on the lock ring 30 as in the case of the embodiment, however, the protruding portion 71 is useful for enhancing the mechanical strength of the fitting portion 11. Even when the fitting portion 11 is wrenched in the operation of fitting or unfitting the portion to the fitted portion 21 of the counter connector C2, therefore, the fear that the fitting portion 11 is damaged can be reduced.

Also the projection 16 and the groove portion 24 of the fitting mechanism 17 are not restricted to the configuration of the embodiment. For example, the projection 16 may be disposed on the side of the counter connector C2 and the groove portion 24 may be disposed on the side of the fitting portion 11. When the projection 16 is disposed on the fitting portion 11 as in the case of the embodiment, however, the projection 16 is useful for enhancing the mechanical strength of the fitting portion 11. Even when the fitting portion 11 is wrenched in the operation of fitting or unfitting the portion to the fitted portion 21 of the counter connector C2, therefore, the fear that the fitting portion 11 is damaged can be reduced.

What is claimed is:

1. An electrical connector with a locking mechanism, comprising:

a cylindrical fitting portion which can be fitted into a cylindrical fitted portion of a counter electrical connector;

a cylindrical lock ring which is attached to said fitting portion so as to be rotatable and axially movable;

a guide face which is formed on said lock face, which extends in a spiral direction, and to which, when said fitted portion is fitted into said fitted portion, an outward projection disposed on said fitted portion is opposed;

a cam face and an engaging face which is continuous with said cam face, said cam face and said engaging face being sectionally formed in said guide face, and, when said lock ring is rotated, being engaged with said outward projection to guide said lock ring toward a lock position in an advancing direction;

a spring member which always urges said lock ring toward an initial position in a retracting direction; and a positioning mechanism that is formed by a protruding portion and a recess portion which is to be fitted onto and unfitted from said protruding portion, said protruding portion and said recess portion are respectively formed on said fitting portion and said lock ring, said positioning mechanism restricts a rotation angle of said lock ring at said initial position, and a restricted state of the rotation angle is canceled by a forward movement of said lock ring toward the lock position.

2. An electrical connector with a locking mechanism according to claim 1, wherein a width of said recess portion of said positioning mechanism is larger than a width of said projection of said positioning mechanism, and an idle space is formed between said projection and said recess portion.

3. An electrical connector with a locking mechanism according to claim 1, wherein an edge portion which protrudes toward an inner side of said lock ring is annularly formed on a rear end portion of said lock ring, said recess portion of said positioning mechanism is formed in one place in a peripheral direction of said edge portion, a trunk portion is continuously disposed on a base of said fitting portion in a stepwise manner, said trunk portion having a diameter which is larger than a diameter of said fitting portion, said protruding portion of said positioning mechanism is formed in a step portion in an interface between said trunk portion and said base, and a step face of said step portion is formed as an abutting face which restricts the initial position of said lock ring.

4. An electrical connector with a locking mechanism according to claim 2, wherein an edge portion which protrudes toward an inner side of said lock ring is annularly formed on a rear end portion of said lock ring, said recess portion of said positioning mechanism is formed in one place in a peripheral direction of said edge portion, a trunk portion is continuously disposed on a base of said fitting portion in a stepwise manner, said trunk portion having a diameter which is larger than a diameter of said fitting portion, said protruding portion of said positioning mechanism is formed in a step portion in an interface between said trunk portion and said base, and a step face of said step portion is formed as an abutting face which restricts the initial position of said lock ring.

5. An electrical connector with a locking mechanism according to claim 3, wherein a spring seat is formed in a place of said fitting portion, said place being positioned more forward than said protruding portion, and said spring member is interposed between said spring seat and said edge portion of said lock ring.

6. An electrical connector with a locking mechanism according to claim 1, wherein a projection and a groove portion which is to be fitted onto and unfitted from said projection are respectively formed on said fitting portion and said fitted portion, said projection and said groove portion form a fitting mechanism which restricts a fitting position between said fitting portion and said fitted portion in a peripheral direction, and an introducing groove for introducing said outward projection to said cam face is formed in said lock ring, said introducing groove elongating from a front end face of said lock ring to a beginning portion of said cam face.

7. An electrical connector with a locking mechanism according to claim 6, wherein a width of an opening of said introducing groove in said front end face of said lock ring is larger than a thickness of said outward projection, and, when said projection of said fitting mechanism is positioned with respect to said groove portion, said outward projection is always opposed to said opening of said introducing groove in said front end face of said lock ring.

8. An electrical connector with a locking mechanism according to claim 7, wherein plural poles are arranged inside said fitting portion.

9. An electrical connector with a lock mechanism according to claim 1, wherein said guide face is formed by an entire wall face of a slot which is formed in said lock ring and which extends in the spiral direction.

10. An electrical connector with a locking mechanism according to claim 3, wherein a mark indicating a position of said projection of said fitting mechanism is formed on an outer face of said trunk portion.

11. An electrical connector with a locking mechanism according to claim 1, wherein a mark indicating a rotation direction for forward moving said lock ring is formed on an outer face of said lock ring.

12. An electrical connector with a locking mechanism according to claim 10, wherein a mark indicating a rotation direction for forward moving said lock ring is formed on an outer face of said lock ring.

* * * * *